US009766025B1

(12) United States Patent
Rood

(10) Patent No.: US 9,766,025 B1
(45) Date of Patent: Sep. 19, 2017

(54) RIFLE RECEIVER

(71) Applicant: Terry L. Rood, North Fort Myers, FL (US)

(72) Inventor: Terry L. Rood, North Fort Myers, FL (US)

( * ) Notice: Subject to any disclaimer, the term of this patent is extended or adjusted under 35 U.S.C. 154(b) by 0 days.

(21) Appl. No.: 15/186,650

(22) Filed: Jun. 20, 2016

Related U.S. Application Data

(60) Provisional application No. 62/234,385, filed on Sep. 29, 2015.

(51) Int. Cl.
*F41A 3/66* (2006.01)
*F41A 9/24* (2006.01)
*F41A 9/34* (2006.01)

(52) U.S. Cl.
CPC ..... *F41A 3/66* (2013.01); *F41A 9/24* (2013.01); *F41A 9/34* (2013.01)

(58) Field of Classification Search
CPC ..... F41A 3/66; F41A 9/29; F41A 9/79
USPC ..... 89/33.1, 33.14, 33.04, 34, 33.2
See application file for complete search history.

(56) References Cited

U.S. PATENT DOCUMENTS 4,392,407 A * 7/1983 LaFever ..... F41A 9/79 89/33.14
4,942,802 A * 7/1990 Stoner ..... F41A 9/32 42/25
6,152,012 A * 11/2000 Sherwood ..... F41A 9/79 89/33.14
6,799,500 B1 * 10/2004 Kulikowski ..... F41A 9/79 89/1.1
7,428,795 B2 * 9/2008 Herring ..... F41A 3/66 42/75.01
2014/0317983 A1 * 10/2014 Bush ..... F42B 5/32 42/17
2015/0330727 A1 * 11/2015 Kolev ..... F41A 3/12 42/16

* cited by examiner

*Primary Examiner* — Reginald Tillman, Jr.

(57) ABSTRACT

A rifle has a receiver. The receiver has a recess with a rectilinear major section and a trapezoidal minor section. The minor section extends upwardly from the major section. The receiver has a chamber above the recess. A rectilinear container has a lid with an upwardly extending projection. The lid is removably received in the minor section of the recess. A plurality of bullets are removably positioned in the container. The bullets extend upwardly through a passageway in the lid and into the chamber.

1 Claim, 5 Drawing Sheets

FIG. 1
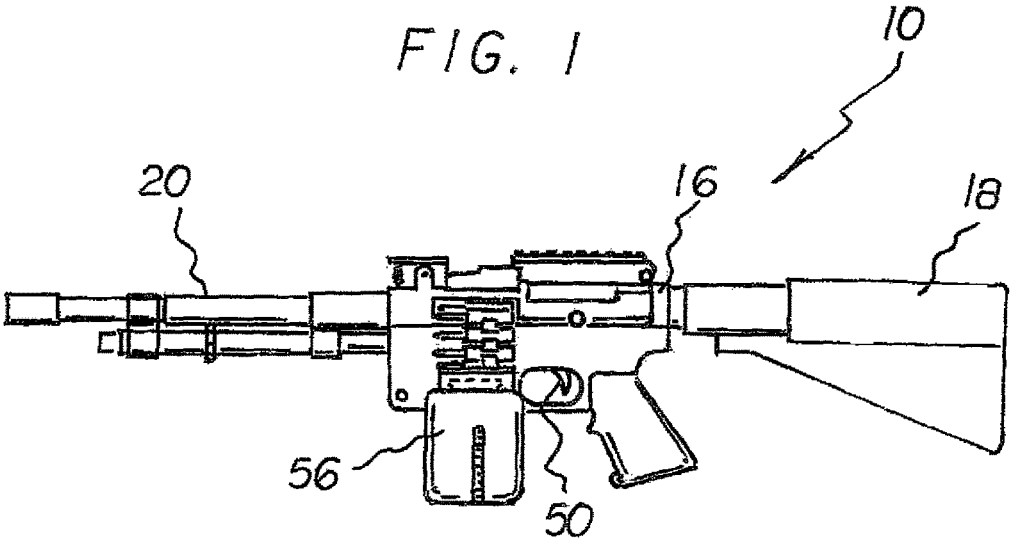
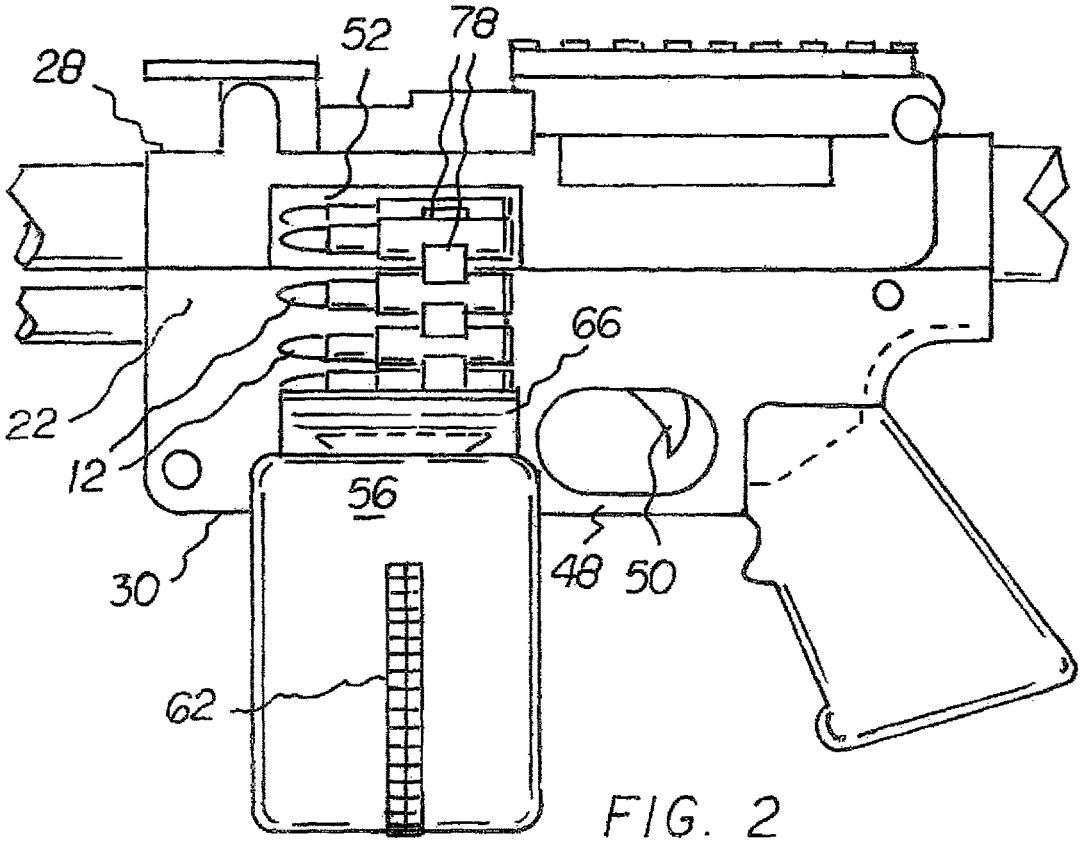
FIG. 2

FIG. 5
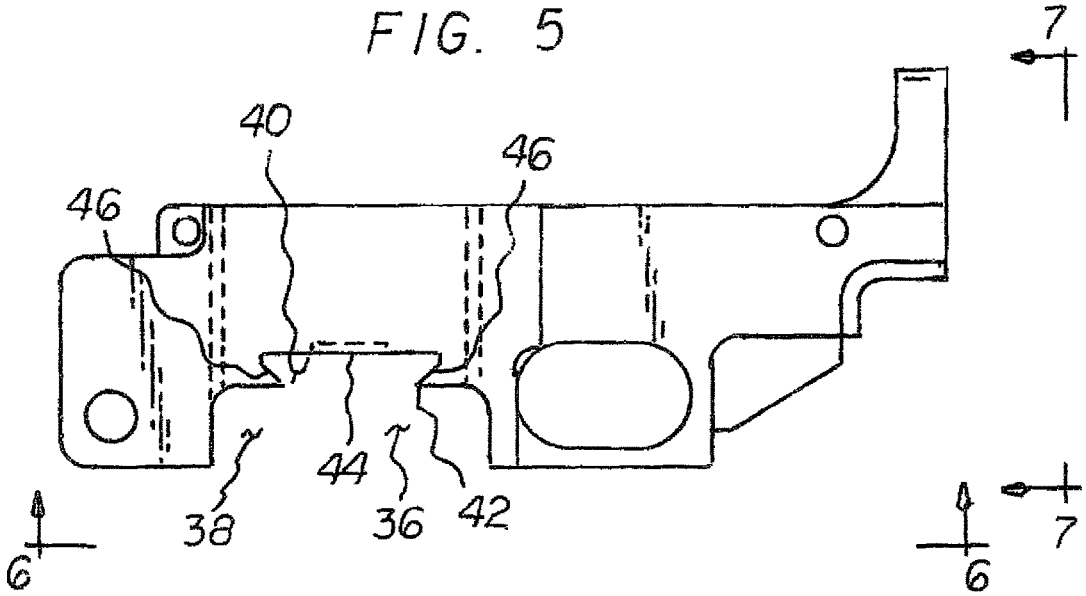
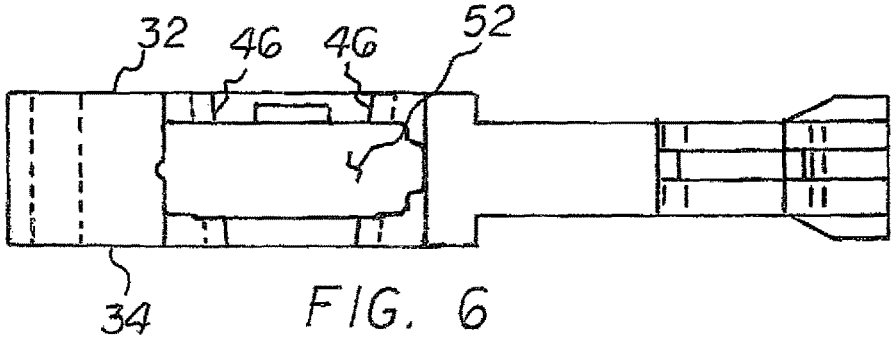
FIG. 6
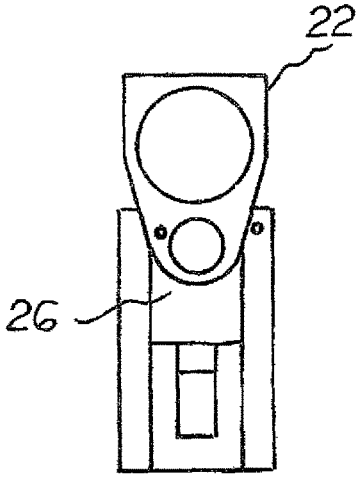
FIG. 7

FIG. 10
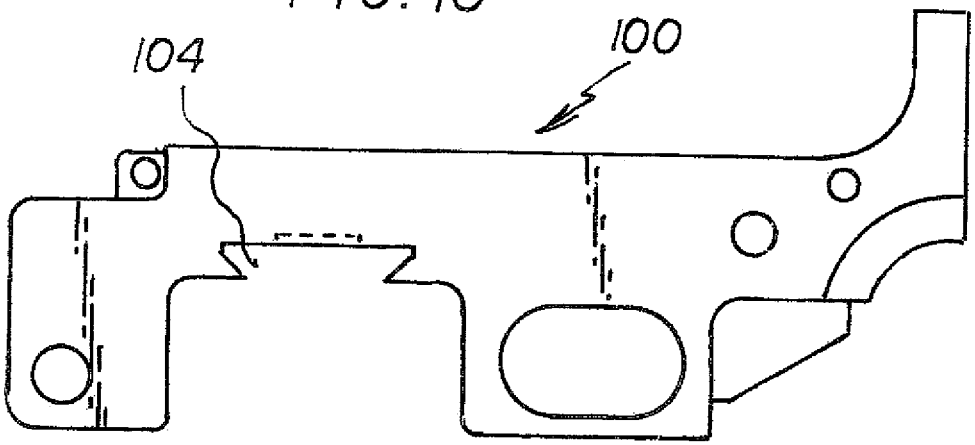
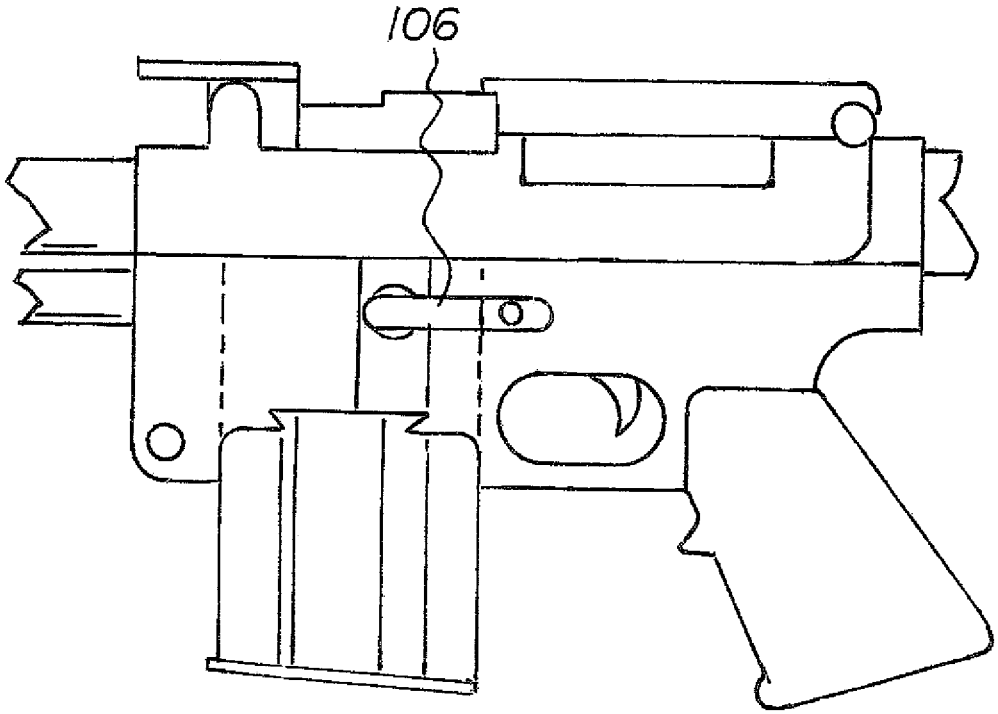
FIG. 11

RIFLE RECEIVER

RELATED APPLICATION

The present application claims priority of and is based upon Provisional Application No. 62/234,385 filed Sep. 29, 2015 the subject matter of which is incorporated herein by reference.

BACKGROUND OF THE INVENTION

Field of the Invention

The present invention relates to a rifle receiver and more particularly pertains to supporting a plurality of bullets and for feeding the bullets sequentially for firing, the supporting and the feeding being done in a safe, convenient, and economical manner.

Description of the Prior Art

The use of rifle receivers of known designs and configurations is known in the prior art. More specifically, rifle receivers of known designs and configurations previously devised and utilized for the purpose of supporting bullets and feeding bullets for firing are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a rifle receiver for supporting a plurality of bullets and for feeding the bullets sequentially for firing, the supporting and the feeding being done in a safe, convenient, and economical manner.

In this respect, the rifle receiver according to the present invention substantially departs from the conventional concepts and designs of the prior art, and in doing so provides an apparatus primarily developed for the purpose of supporting a plurality of bullets and feeding the bullets sequentially for firing, the supporting and the feeding being done in a safe, convenient, and economical manner.

Therefore, it can be appreciated that there exists a continuing need for a new and improved rifle receiver which can be used for supporting a plurality of bullets and for feeding the bullets sequentially for firing, the supporting and the feeding being done in a safe, convenient, and economical manner. In this regard, the present invention substantially fulfills this need.

SUMMARY OF THE INVENTION

In view of the disadvantages inherent in the known types of rifle receivers of known designs and configurations now present in the prior art, the present invention provides an improved rifle receiver. As such, the general purpose of the present invention, which will be described subsequently in greater detail, is to support a plurality of bullets and for feeding the bullets sequentially for firing, the supporting and the feeding being done in a safe, convenient, and economical manner.

To attain this, from a broad viewpoint, the present invention is a rifle receiver. A rifle is provided. The rifle has a receiver. The receiver has a recess. The recess has a major section. The major section is rectilinear in configuration. The recess also has a minor section. The minor section is trapezoidal in configuration. The minor section extends upwardly from the major section. The receiver has a chamber 52. The chamber is above the recess. A container is provided next. The container is rectilinear in configuration. The container has a lid. The lid has an upwardly extending projection. In this manner the lid may be removably received in the minor section of the recess. The lid has a passageway. A plurality of bullets are removably positioned in the container. The bullets extend upwardly through the passageway and into the chamber.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved rifle receiver which has all of the advantages of the prior art rifle receivers of known designs and configurations and none of the disadvantages.

It is another object of the present invention to provide a new and improved rifle receiver which may be easily and efficiently manufactured and marketed.

It is a further object of the present invention to provide a new and improved rifle receiver which is of durable and reliable constructions.

An even further object of the present invention is to provide a new and improved rifle receiver which is susceptible of a low cost of manufacture with regard to both materials and labor, and which accordingly is then susceptible of low prices of sale to the consuming public, thereby making such rifle receiver economically available to the buying public.

Lastly, it is an object of the present invention to provide a rifle receiver for supporting a plurality of bullets and for feeding the bullets sequentially for firing, the supporting and the feeding being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a rifle receiver system constructed in accordance with the principles of the present invention.

FIG. 2 is an enlarged showing of a central region of the system of FIG. 1 with a bullet in the chamber.

FIG. 5 is a side elevational view of the receiver of FIGS. 1-3.

FIG. 6 is a bottom view of the receiver taken along line 6-6 of FIG. 5.

FIG. 7 is a front end elevational view of the receiver taken along line 7-7 of FIG. 5.

FIG. 10 is a side elevational view of the receiver shown in FIGS. 8 and 9.

FIG. 11 is a side elevational view of an old style clip in position.

The same reference numerals refer to the same parts throughout the various Figures.

DESCRIPTION OF THE PREFERRED EMBODIMENT

Figure 3:
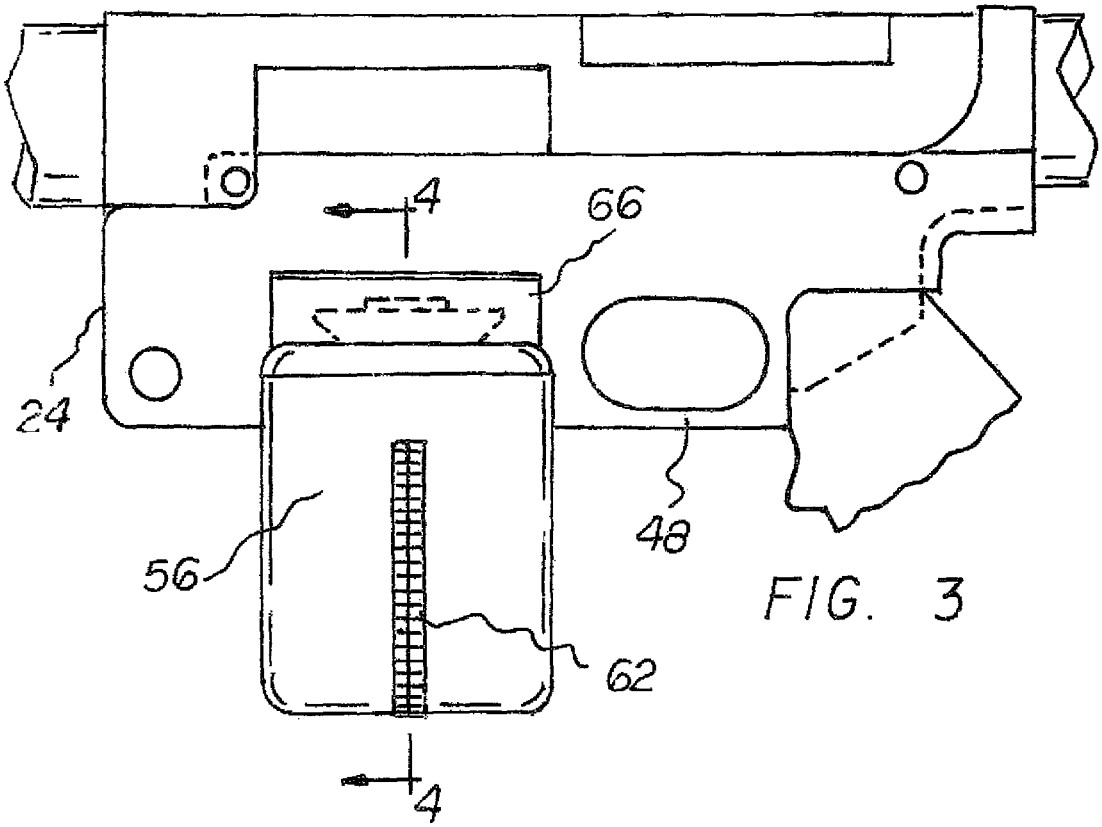
FIG. 3 is a showing similar to FIG. 2 but prior to positioning a bullet in the chamber.
Figure 4:
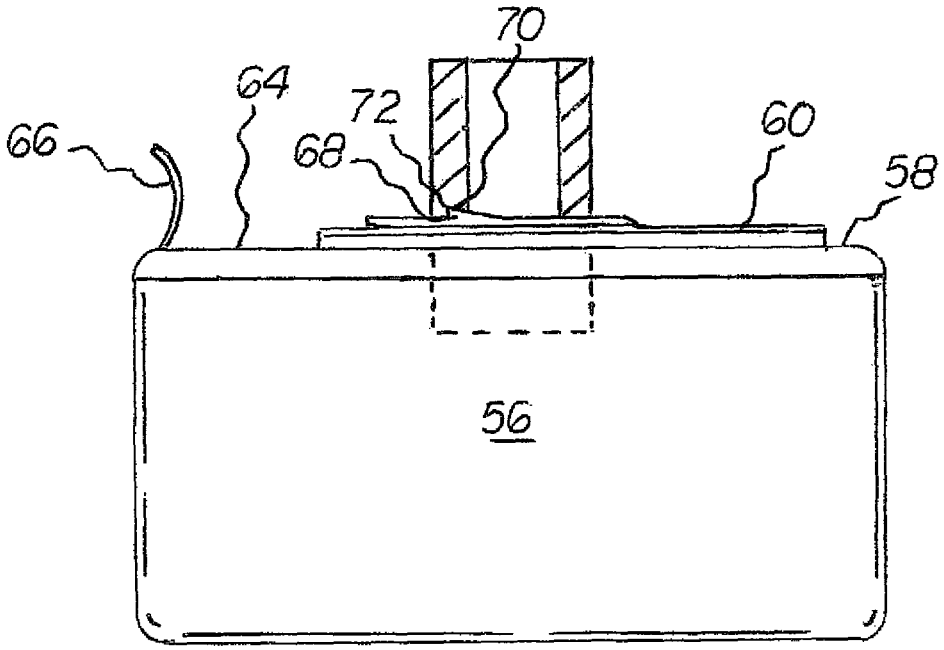
FIG. 4 is a cross sectional view taken along line 4-4 of FIG. 3.
Figure 8:
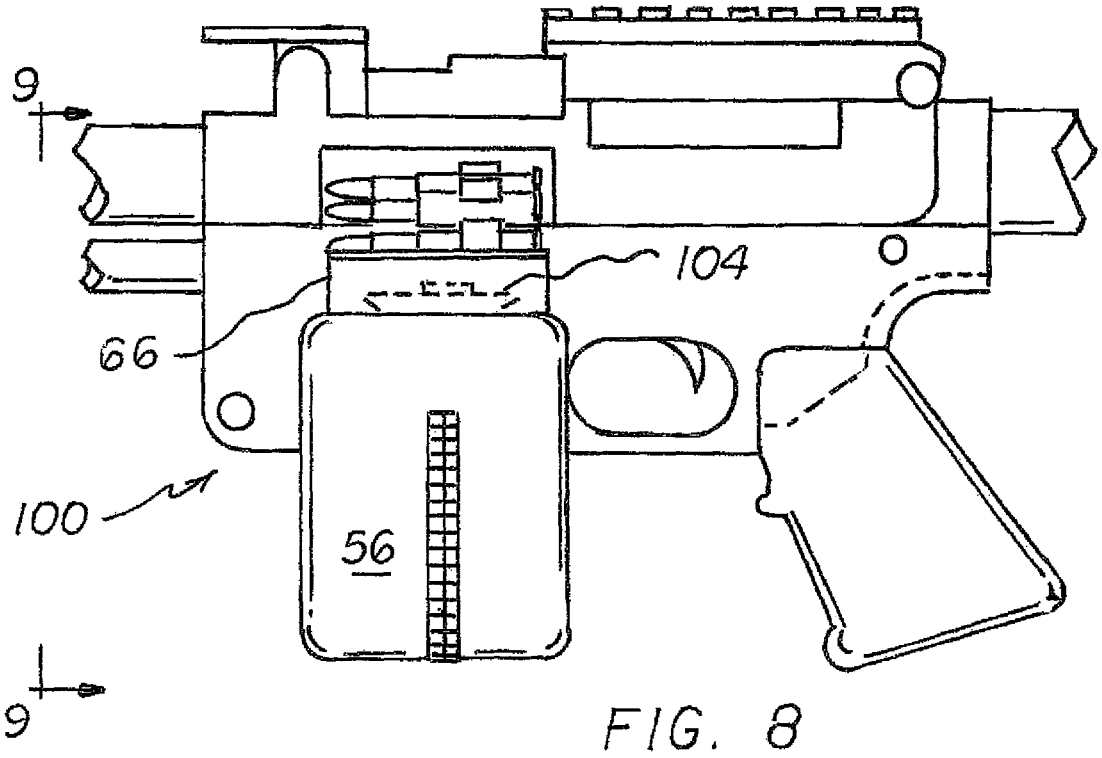
FIG. 8 is a side elevational view similar to FIG. 2 but illustrating an alternate embodiment of the invention.
Figure 9:
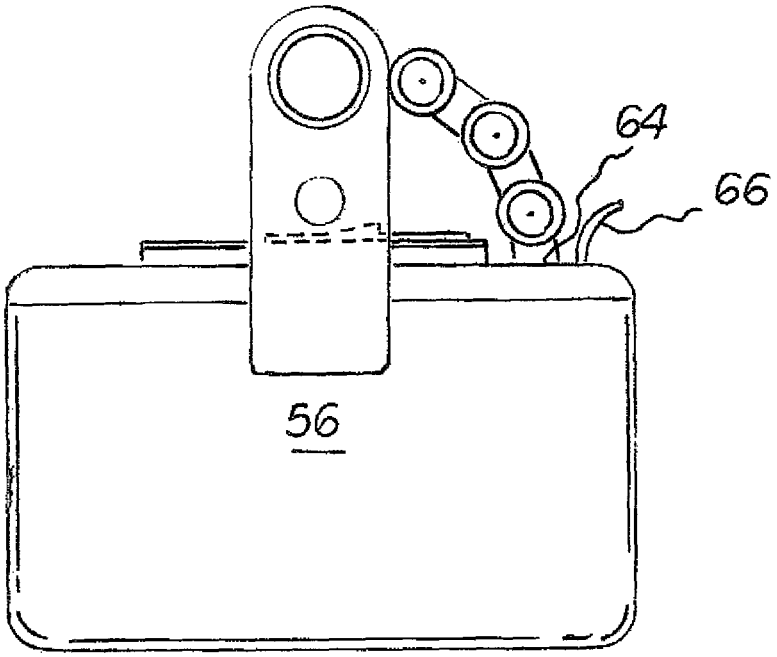
FIG. 9 is a front end elevational view of the embodiment of FIG. 8.

With reference now to the drawings, and in particular to FIG. 1 thereof, the preferred embodiment of the rifle receiver embodying the principles and concepts of the present invention and generally designated by the reference numeral 10 will be described.

The present invention, the rifle receiver 10 is comprised of a plurality of components. In their broadest context such include a rifle, a container, and bullets. Such components are individually configured and correlated with respect to each other so as to attain the desired objective.

From a specific perspective, the invention of the present application is a rifle receiver. First provided is a rifle 16. The rifle has a stock 18 rearwardly. The rifle also has a barrel 20 forwardly. The rifle further has a receiver 22 between the stock and the barrel. The receiver has a forward end 24 and a rearward end 26. The forward end and the rearward end are separated by a length. The receiver has an upper region 28 and a lower region 30. The upper region and the lower region are separated by a height. The receiver has a left side 32 and a right side 34. The left side and the right side are separated by a width. The receiver has a recess 36. The recess is formed in the receiver between the forward end and the rearward end. The recess extends between the left side and the right side. The recess has a major section 38 which is rectilinear in configuration. The major section extends upwardly from the lower region. The recess has a minor section 40 which is trapezoidal in configuration. The minor section extends upwardly from the major section. The minor section has a horizontal bottom 42 coextensive with the major section. The minor section has a horizontal top 44 above and parallel with the bottom. The minor section has angled sides 46 between the bottom and the top. The top is larger than the bottom. The top is closer to the lower region than to the upper region. The receiver has a trigger 50 and a trigger 48 guard. The trigger and trigger guard are located in the receiver between the recess and the stock. The receiver further has a chamber 52 above the recess.

A container 56 is provided next. The container is rectilinear in configuration. The container has a lid 58 with an upwardly extending projection 60. The projection is trapezoidal in shape and size. In this manner the lid may be removably received in the minor section of the recess. A zipper 62 is formed in the container for loading the contents of the container. The lid has a passageway 64 and an associated guide 66 in an arcuate configuration.

Further provided is a positioning assembly 68 to insure proper positioning of the container with respect to the receiver for operation and use. The positioning assembly includes a vertically disposed sliding surface 70 formed in the projection. The positioning assembly also includes a vertically disposed fixed surface 72 formed in the receiver. The fixed surface functions to limit the lateral movement and determine the proper location of the sliding surface when removably coupling the container to the receiver.

A plurality of bullets 12 are provided last. A strap 78 couples the bullets together side to side. The bullets are removably positioned in container extending upwardly through the passageway 64 in the lid and into the chamber. The guide 66 functions to insure proper movement of the bullets between the container and the chamber.

An alternate embodiment of the invention is shown in FIGS. 10 and 11. In this alternate embodiment, the rifle receiver 100 has a minor recess 104 located closer to the upper region than to the lower region. In this embodiment a lock 106 is included. The lock couples the container to the rifle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rifle receiver system (10) for supporting a plurality of bullets (12) and for feeding the bullets sequentially for firing, the system comprising, in combination:

a rifle (16) having a stock (18) rearwardly, a barrel (20) forwardly, and a receiver (22) between the stock and the barrel, the receiver having a forward end (24) and a rearward end (26) separated by a length, the receiver having an upper region (28) and a lower region (30) separated by a height, the receiver having a left side (32) and a right side (34) separated by a width, the receiver having a recess (36) formed in the receiver between the forward end and the rearward end and extending between the left side and the right side, the recess having a major section (38) in a rectilinear configuration extending upwardly from the lower region, the recess having a minor section (40) in a trapezoidal configuration extending upwardly from the major section, the minor section having a horizontal bottom (42) coextensive with the major section, the minor section having a horizontal top (44) above and parallel with the bottom, the minor section having angled sides (46) between the bottom and the top, the top being larger than the bottom, the top being closer to the lower region than to the upper region, a trigger guard (48) with a trigger (50) located in the receiver between the recess and the stock, the receiver having a chamber (52) above the recess;

a container (56) formed in a rectilinear configuration, the container having a lid (58) with an upwardly extending projection (60), the projection having a trapezoidal shape and size for being removably received in the minor section of the recess, a zipper (62) formed in the container for loading the contents of the container, the lid having a passageway (64) and an associate guide (66) in an arcuate configuration;

a positioning assembly (68) for insuring the proper positioning of the container with respect to the receiver for operation and use, the positioning assembly including a vertically disposed sliding surface (70) formed in the projection, the positioning assembly also including a vertically disposed fixed surface (72) formed in the, the projection the fixed surface functioning to limit lateral movement and determine the proper location of the sliding surface when removably coupling the container to the receiver; and a plurality of bullets (12) with a strap (78) coupling the bullets together side to side, the plurality of bullets being removably positioned in the container and extending upwardly through the passageway (58) and into the chamber, the guide (64) functioning to insure proper movement of the bullets between the container and the chamber and upwardly through the chamber.

* * * * *